US008733021B2

(12) United States Patent
Lambertini

(10) Patent No.: US 8,733,021 B2
(45) **Date of Patent: *May 27, 2014**

(54) CASEMENT WINDOW UNIT WITH AN OPERATING AND CLOSING SLIDE UNIT FOR THE MOVABLE FRAME OF THE WINDOW UNIT

(75) Inventor: Marco Lambertini, San Lazzaro di Savena (IT)

(73) Assignee: GSG International S.p.A., Budrio (IT)

( * ) Notice: Subject to any disclaimer, the term of this patent is extended or adjusted under 35 U.S.C. 154(b) by 55 days.

This patent is subject to a terminal disclaimer.

(21) Appl. No.: 13/497,014

(22) PCT Filed: Sep. 24, 2010

(86) PCT No.: PCT/IB2010/054312

§ 371 (c)(1), (2), (4) Date: Mar. 19, 2012

(87) PCT Pub. No.: WO2011/036639

PCT Pub. Date: Mar. 31, 2011

(65) Prior Publication Data

US 2012/0180392 A1 Jul. 19, 2012

(30) Foreign Application Priority Data

Sep. 28, 2009 (IT) ..... BO2009A0619

(51) Int. Cl.
*E05D 15/00* (2006.01)

(52) U.S. Cl.
USPC ..... 49/250; 49/246; 49/248; 49/251; 49/252; 49/260; 49/394

(58) Field of Classification Search
USPC ..... 49/246–253, 260, 261, 394, 395, 192, 49/193; 292/292, DIG. 20, DIG. 47, 142, 292/143
See application file for complete search history.

(56) References Cited

U.S. PATENT DOCUMENTS

| | | | | | |
|---|---|---|---|---|---|
| 2,688,779 | A | * | 9/1954 | Westman | 49/252 |
| 3,004,304 | A | * | 10/1961 | Wilhelm | 49/192 |
| 4,610,472 | A | * | 9/1986 | Billingsley | 292/54 |
| 4,616,864 | A | * | 10/1986 | Douglas | 292/336.3 |
| 4,726,092 | A | | 2/1988 | Tacheny et al. | |

(Continued)

FOREIGN PATENT DOCUMENTS

| | | |
|---|---|---|
| CN | 101131061 | 2/2008 |
| DE | 687995 | 2/1940 |

(Continued)

*Primary Examiner* — Katherine Mitchell
*Assistant Examiner* — Marcus Menezes
(74) *Attorney, Agent, or Firm* — Pearne & Gordon LLP

(57) ABSTRACT

A casement window unit including a fixed frame (2); a movable sash (3) connected to the fixed frame by a pair of hinged members (4, 5) joined to respective members of the fixed frame and of the sash so as to allow the movable sash to move between a closed position, where the fixed frame and the sash are in contact with each other, and an open position, where at least one stile (3*c*) of the sash is at a certain distance from the fixed frame towards the outside of the room where the window unit (1) is installed, and vice versa; and a movement arm (7) acting on the sash in such a way that it moves the sash from the closed position to the open position, and vice versa.

14 Claims, 11 Drawing Sheets

(56) References Cited

U.S. PATENT DOCUMENTS

| | | | | |
|---|---|---|---|---|
| 4,803,808 | A * | 2/1989 | Greisner | 49/394 |
| 4,807,914 | A * | 2/1989 | Fleming et al. | 292/48 |
| 4,942,694 | A | 7/1990 | Simoncelli | |
| 5,370,428 | A * | 12/1994 | Dreifert et al. | 292/161 |
| 7,396,054 | B2 * | 7/2008 | Carrier | 292/75 |
| 7,464,619 | B2 | 12/2008 | Vetter | |
| 2008/0000164 | A1 * | 1/2008 | Erickson et al. | 49/394 |
| 2008/0250719 | A1 | 10/2008 | Griffin et al. | |

FOREIGN PATENT DOCUMENTS

| | | | | |
|---|---|---|---|---|
| DE | 3241994 | A1 * | 5/1984 | E05D 15/30 |
| DE | 20316561 | | 1/2004 | |
| EP | 0362095 | | 4/1990 | |
| EP | 0740041 | | 10/1996 | |
| GB | 2208173 | A * | 3/1989 | E05C 9/10 |

* cited by examiner

CASEMENT WINDOW UNIT WITH AN OPERATING AND CLOSING SLIDE UNIT FOR THE MOVABLE FRAME OF THE WINDOW UNIT

TECHNICAL FIELD

This invention relates to a casement window unit, having a sash that opens outwards.

The window of the invention may be included in window configurations with traditional opening style, that is to say, windows that rotate about a vertical axis on traditional hinges, or in the field of traditional windows known in the jargon of the trade as "side hung" windows.

BACKGROUND ART

Hereinafter, this specification will describe prior art solutions derived from the side hung window but without limiting the scope of the invention to side-hung windows with traditional opening style, that is to say, with hinges configured to make the sash rotate about only one vertical axis.

Outward opening side-hung window units, usually made of metal, PVC or the like and of wood, are used for airing rooms and the parts of the windows inside the rooms are often equipped with accessories such as fly screens. In addition, to comply with safety regulations in the countries in which these window units are most widely used, these window units must have controlled opening with a limit on the angle achievable by the sash moving away from the fixed frame.

The window unit basically comprises:

- a fixed frame;
- a movable frame, or sash, usually connected to the fixed frame by
- a pair of hinged arms interposed between the respective upper and lower rails of the two frames;
- an operating unit located on the rail of the fixed frame and acting on the lower hinge or directly on the lower rail, allowing the sash to move away from the fixed frame (that is to say, controlled sash opening) and also allowing the sash to return in contact with the fixed frame;
- an element for stably closing the sash on the fixed frame, the element usually being located on a fixed frame stile and acting on the respective sash stile (opposite that closest to the hinged arms) for stabilising closing.

As can be seen in document U.S. Pat. No. 4,726,092 each of the above-mentioned hinged arms may comprise:

- a support stably associated with the respective fixed frame rail and close to a fixed frame corner zone;
- a first connecting arm hinged, at its ends, to the support and, respectively, to the end of a second arm which is associated with the sash lower rail to allow the opening and closing movements.

The opposite, free end of the second arm is connected to a slide inserted in the support, which also allows the sash to slide along the two fixed frame rails, rendering sash opening a rotating—translating movement with the sash stile moved away from the fixed frame stile (an operation which may also allow improved access for cleaning the outer part of the glass from inside the room).

The operating unit or rotor, designed to control sash opening and closing, may comprise, normally and in prior art solutions as is also shown in documents U.S. Pat. No. 7,464,619 or CN 101131061, a housing unit for a control shaft, the unit being fixed on the outer edge of the fixed frame lower rail.

The control shaft has an inner portion equipped with a mechanism usually comprising helical toothing designed to mesh with a respective helical toothing or semi-toothing made around an operator arm pivot point inside the housing unit.

The operator arm is interposed between the lower rails of the fixed frame and the sash and is articulated, at its free end, to the sash rail.

The control shaft protrudes from the housing unit for connecting with a handle which is fixed or preferably applied by the user when necessary, thus allowing sash movement by manually turning the handle.

Obviously, the presence of the connecting point between the operator arm and the sash provides a low security closing seal, therefore, a second element is added, such as the above-mentioned stable closing element.

This element (also visible, in a prior art solution in document US 2008250719) substantially comprises a lock handle applied on the fixed frame stile and connected to a rod sliding along the inner part of the stile.

Therefore, the purpose of the rod is to form a connecting element between the sash and the fixed frame and it can usually be fitted with one or more strikers which, when the sash is closed, engage respective rollers or retaining elements present on the sash stile, resulting in stable closing of the window unit.

A window unit structured in that way has revealed disadvantages due to the separate structure of the operating and closing units.

As may be inferred from the above description, assembly of the operating unit requires complex machining on the outer profile (through-slots) of the fixed frame and, above all, machining also on the inner part of the fixed frame to allow the hinged arms and the operator arm to coexist. The presence of both necessitates machining on the thicknesses of the rails to render the window unit accessible for these operating elements (even in a superposed position).

Added to this is the need for machining on the window unit stiles (in particular through-slot openings) for allowing the insertion of the closing element.

Therefore, basically a window unit structured in that way is complex to make and so is expensive overall, as well as having complex operation as far as the user is concerned (obliged to go through various steps to open and close the window).

DISCLOSURE OF THE INVENTION

This invention therefore has for an aim to overcome these disadvantages by producing a casement window unit of the type described above which is simplified and equipped with a single control point from which it is possible to move the sash to open and close the window and also for simple, practical secure stable closing of the sash on the window unit, reducing the machining needed on the window unit and, therefore, its overall costs.

According to the invention, this aim is achieved by a window unit, in particular a controlled opening casement window unit characterized in that it comprises: an operating slide unit positioned and movable in the fixed stile to slidably support the closing elements located on the fixed frame; a kinematic operating pair connecting the slide to a first end of the movement arm; at the other end, the arm is articulated to the stile of the movable frame; a control handle, associated with the outside of the fixed frame and connected to the slide in order to move it, when actuated manually to predetermined positions, in such a way as to allow, in sequence, first the sash to be released from the fixed frame and then the sash to be moved towards the open position, and vice versa.

The presence of the slide combined with the kinematic pair thus allows the two operations of releasing and opening or closing and locking the sash to be carried out intuitively and conveniently using a single handle.

Also according to the invention, the slide comprises at least two separate portions that can be joined to each other inside the arm. The first portion mounts the closing elements for closing the fixed frame, while the second portion constitutes one of the members of the kinematic pair.

This configuration makes it possible to fit a closing system combined with the operating part of the slide according to the size of the window it is to be mounted on.

BRIEF DESCRIPTION OF THE DRAWINGS

The technical features of the invention, with reference to the above aims, are clearly described in the claims below and its advantages are more apparent from the detailed description which follows, with reference to the accompanying drawings which illustrate a non-limiting example embodiment of it and in which:

DETAILED DESCRIPTION OF THE PREFERRED EMBODIMENTS OF THE INVENTION

Figure 1:
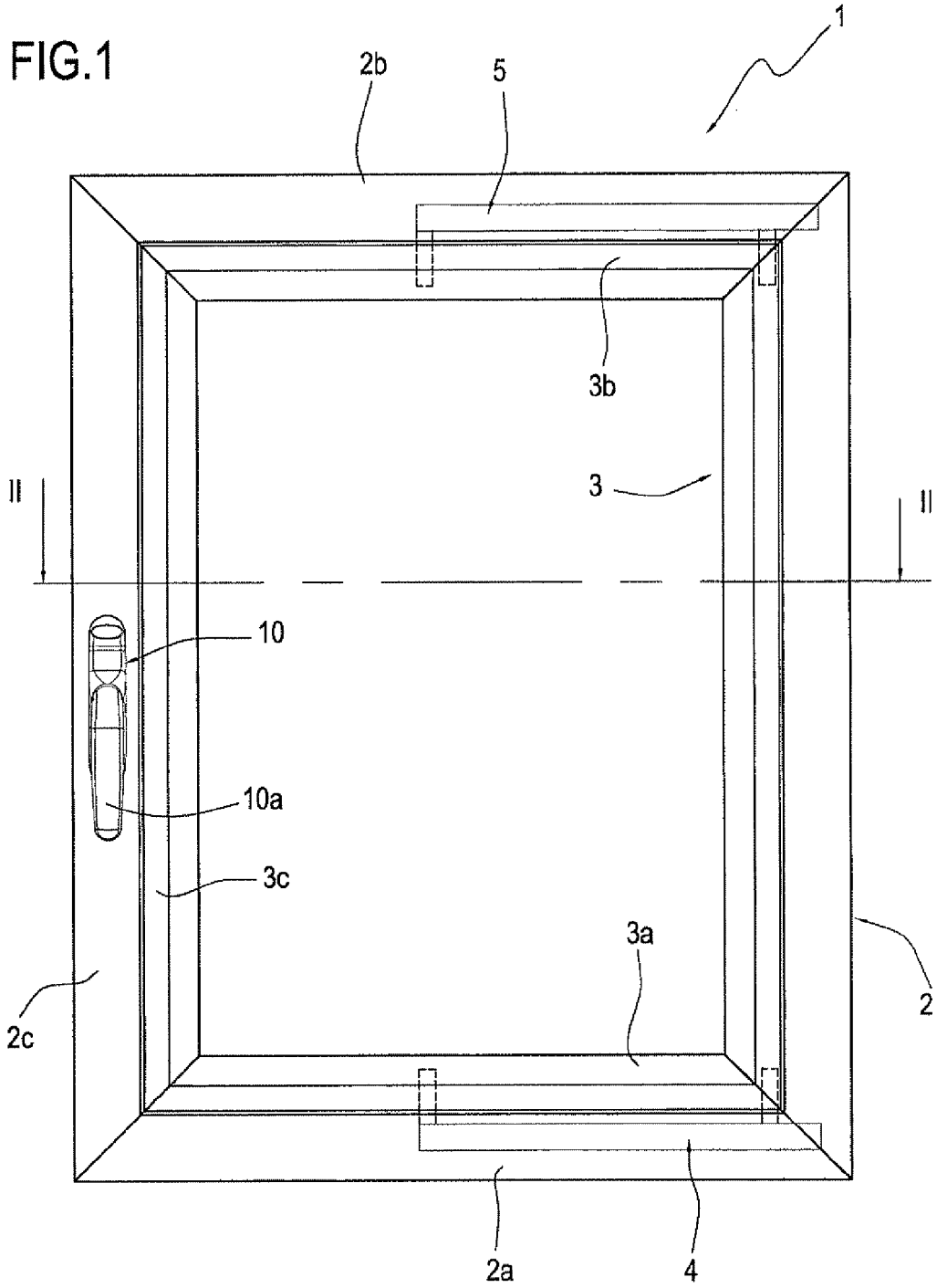
FIG. 1 is a schematic front view of an outward opening casement window unit in accordance with this invention.
Figure 2:
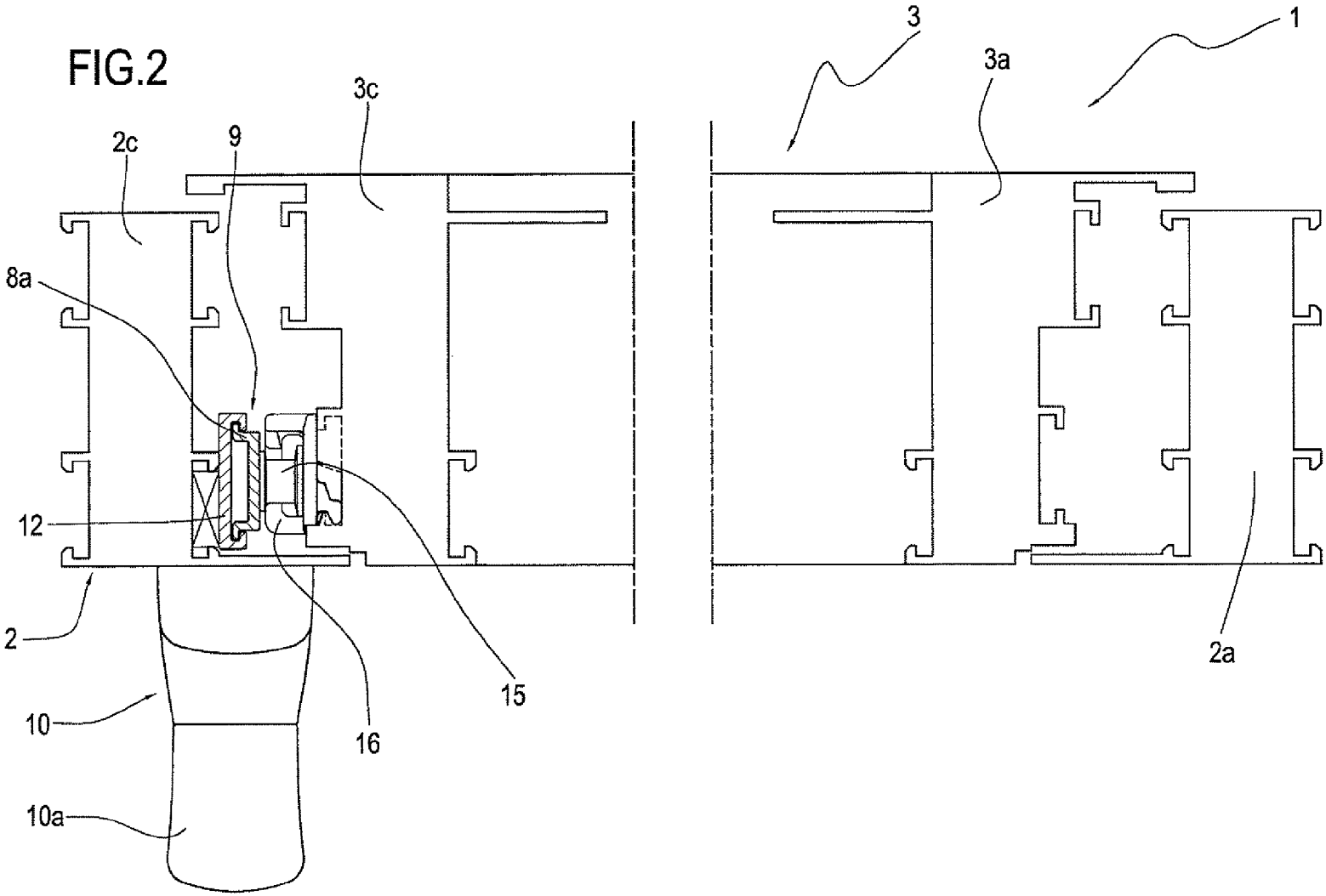
FIG. 2 is a cross section along the line II-II with some parts cut away and referred to FIG. 1, in which the window unit is in a closed configuration.
Figure 3:
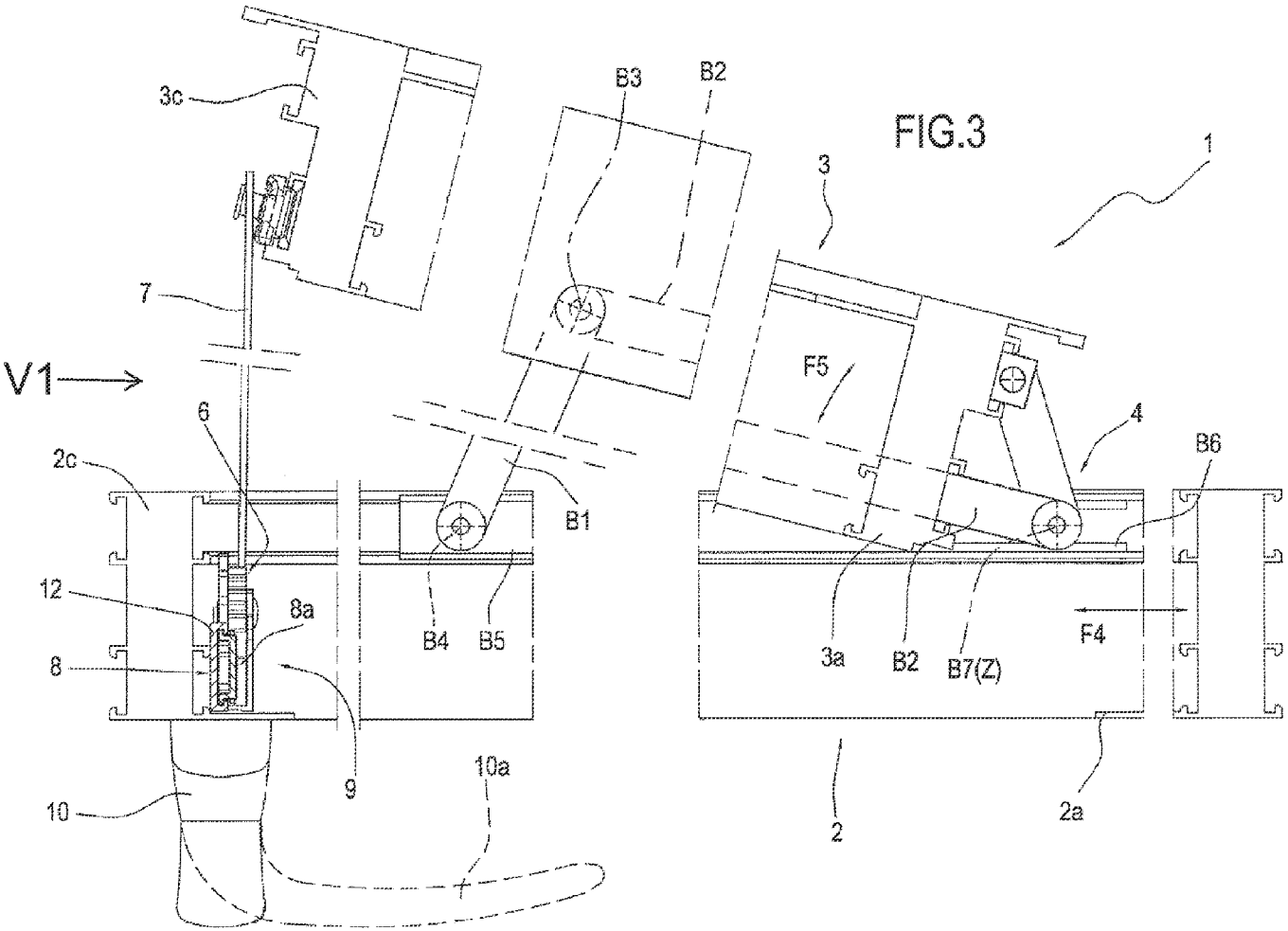
FIG. 3 is a view of the window unit of FIG. 2 in an open configuration.

With reference to the accompanying drawings, and in particular with reference to FIGS. 1 to 3, the window unit according to the invention, denoted by the numeral 1, is of the outward opening casement type.

More specifically, the window unit illustrated is of the type known in the jargon of the trade as "side-hung", to which this description will expressly refer without limiting the scope of the invention, which can also be applied to outward opening casement windows with traditional hinges, that is, where the sash turns about only one vertical axis.

This window unit 1 basically comprises: a fixed frame 2, a movable frame or sash 3, a pair of hinged arms 4, 5, an operating unit 6 comprising several members (described in more detail below) and closing elements 8.

The fixed frame 2 has a pair of vertical members or stiles (one of which is labelled 2*c*), parallel with each other, and a pair of horizontal members or rails 2*a* and 2*b*, parallel with each other.

The sash 3 has a pair of vertical members or stiles (one of which is labelled 3*c*), parallel with each other, and a pair of horizontal members or rails 3*a* and 3*b*, parallel with each other.

As clearly shown in FIGS. 1 to 3, the sash 3 is connected to the fixed frame 2 by a pair of hinged arms 4 and 5 joined to respective members of the fixed frame 2 and of the sash 3 so as to allow the movable sash to move between a closed position, where the fixed frame and the sash 2 and 3 are in contact with each other, and an open position, where at least one stile 3*c* of the sash is at a certain distance from the fixed frame 2 towards the outside of the room where the window unit 1 is installed, and vice versa.

As illustrated in FIGS. 1 to 3, the hinged members consist, for example, of hinged arms 4 and 5, each of which is interposed between the respective lower rails 2*a*, 3*a* and upper rails 2*b*, 3*b* of the fixed frame 2 and sash 3: these hinged arms 4 and 5 are of the widely known type and only schematically illustrated in FIG. 3.

The example in FIG. 3 shows the lower hinged arm 4, since the upper arm is identical.

This hinged arm 4 comprises two rods B1 and B2 articulated to each other at B3. The first rod B1 is, in turn, articulated at B4 to a fixed guide B5 located on the lower rail 2*a* of the fixed frame 2, whilst the second rod B2 is associated with the lower part of the sash 3 rail 3*a*.

In addition, the fixed guide B5 is equipped with a slide B6 which slides in it and which is articulated, at B7, to the rear end of the second rod B2.

This structure of the hinged arms 4 and 5 allows the sash 3 to perform a rotating—translating movement along the rails 2*a*, 2*b*, 3*a*, 3*b* and, respectively, about a vertical axis Z (see arrows F4 and F5 in FIG. 3) between a closed position, with the frames 2, 3 in contact (see FIG. 2), and an open position, with the sash 3 at a certain distance from the fixed frame 2 in an outward direction away from the room in which the window unit 1 is mounted (see FIG. 3), and vice versa.

The operating unit 6 comprises at least one movement arm 7, configured to move the sash 3, by a pushing action, from the above mentioned closed position to the open position, and vice versa, by a pulling action.

The elements 8 for stable closing or locking/releasing of the sash 3 closed position on/from the fixed frame 2 are positioned and act on/between the fixed frame 2 and the sash 3 at least at two respective stiles 2*c*, 3*c* (preferably those opposite the zone where the hinged arms 4, 5 mounted).

According to the invention and as FIGS. 1 to 3 and FIGS. 4 to 7 clearly show, the window unit 1 comprises a slide 9 forming part of the operating unit 6 and positioned along the stile 2*c* of the fixed frame 2.

The slide 9 slidably supports the closing elements 8 on the fixed frame 2.

As FIG. 3 clearly shows, the movement arm 7 is articulated at one end of it to the stile 3*c* of the sash 3 (with prior art systems not described in detail here, since they are not strictly part of the invention).

The other end of the arm 7 is connected to the slide 9 by a kinematic pair 13, 14 (forming part of the operating unit 6).

Also according to the invention, the window unit 1 comprises a control handle 10 associated with the outside of the fixed stile 2*c* and connected to the slide 9 in order to move it, when actuated manually to predetermined positions, in such a way as to allow, in sequence, first the sash 3 to be released from the fixed frame 2 and then the sash 3 to be moved (in this specific embodiment, by a roto-translational movement) towards the open position, and vice versa (as will become clearer as this description continues).

For the purpose, the handle 10 comprises a drive element 11 connected to the slide 9 in such a way that it allows the above-mentioned sequential movements by turning of the handgrip 10*a* of the handle 10 to at least two successive positions relative to the starting position (starting from a closed or open position).

More in detail, the slide 9 is housed inside a guide arm 12 (in practice a frame) associated with the inside of the fixed stile 2*c* (by suitable screws) and in which the slide 9 itself is slidable.

Also according to the invention, the slide 9 comprises at least two separate portions that can be joined to each other inside the arm 12.

The first portion mounts the closing elements 8 for closing the fixed frame 2.

The second portion of the slide 9 constitutes one of the members of the kinematic pair 13 and 14.

The kinematic pair 13 and 14 comprises a variable-pitch rack 13 which is formed on the second portion of the slide 9 and which slides in the guide arm 12, and a pinion 14, also having a variable pitch.

The rack 13 and the pinion 14 operate in conjunction with each other, and the end of the sash 3 movement arm 7 is articulated to the pinion 14, at 6*a*.

The rack 13 and the pinion 14 also have surfaces which can mesh in such a way as to generate the sequential movements for sash 3 opening and closing by rotation of the movement arm 7 (see arrows F7).

In the embodiment illustrated, the slide 9 is divided into at least three separate portions which can be connected to each other.

Two of these portions are rod portions 8*a*, 8*b* slidable in the guide arm, 12, located on both sides, and able to be connected to the portion of the slide 9 on which the rack 13 is formed.

The mutual connection is accomplished by projections 130 on the ends of the rack 13 and matchingly shaped recesses 80 on the rod portions 8*a*, 8*b*.

Each rod portion 8*a*, 8*b*, on which the closing elements are positioned, comprises at least one pin 15 or boss for engaging a respective striker 16 positioned on the lateral surface of the stile 3*c* of the sash 3, when the sash 3 is in the closed position.

The strikers 16 thus form the other part of the closing elements 8.

In addition, one of the rod portions 8*b* is equipped with a pin 17 or boss able to engage in the drive element 11 on the handle 10. The drive element 11 passes through a suitable slot (not illustrated) in the fixed stile 2*c*, allowing sliding of the slide 9 (that is, simultaneous movement of the rod portions 8*a* and 8*b* and of the rack 13) along the guide arm 12 in both directions (arrows F11), thus generating the sequential opening and closing movement of the sash 3.

Returning to the kinematic pair 13 and 14, the rack 13 and the pinion 14 have a flat operating portion 13*a*, 14*a* designed to allow them to slide relative to each other without pinion 14 rotation (as indicated, rack 13 sliding), when the control handle 10 is operated. This configuration allows the movement arm 7 to be held stationary and positioned between the respective stiles 2*c*, 3*c* of the fixed frame 2 and the sash 3, whilst the upstroke of the slide 9, that is, of the rod portions 8*a* and 8*b* of the rack 13 allows sash 3 release, or locking (in the return case) by the bosses 15 relative to the strikers 16 (see FIG. 5).

More precisely, the flat operating portion 13*a* of the rack 13 comprises a linear zone of the rack 13 connecting to at least one section of variable-pitch toothing 13*b* forming a surface which can mesh with a respective toothed surface of the pinion 14.

The extent of the linear zone ZL corresponds to at least one stroke C which can simultaneously be performed by the rod portions 8*a*, 8*b* supporting the pins 15 or bosses for releasing themselves from or connecting to the strikers 16 on the sash 3.

Figure 13:
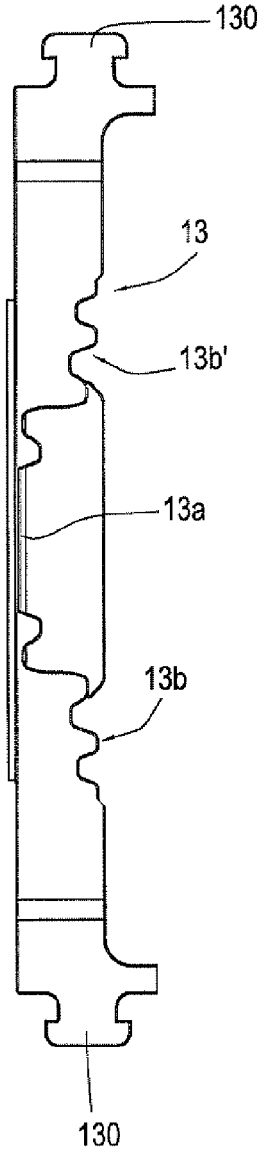
Figure 15:
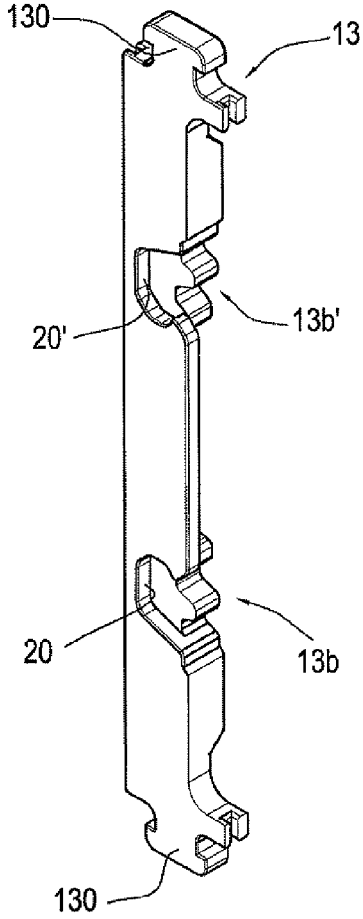

As FIGS. 13 and 15 also show, the flat portion 13*a* forms a central section of the rack 13, both sides of the flat portion connecting to two specular toothed zones 13*b*, 13*b*'. This allows reversible assembly of the rack 13 on the window unit 1 with opening to the right or to the left.

The pinion 14 comprises (see also FIGS. 9 to 12):

- a first, supporting portion 14*b*, on which the movement arm 7 is rigidly articulated, at 6*a* by mechanical constraints of the known type, and
- a second, operating control portion 14*c*, which is thicker than the first portion 14*b*.

This second portion 14*c* comprises the flat-profile front zone 14*a* and at least one zone, adjacent to this substantially flat tooth 14*a* and having toothing 14*d* which can mesh with the respective toothing 13*b* of the rack 13.

This second portion 14*c* is rotatably connected, at X, to a pin 18 which is part of a rack 13 covering element 19 and integral with the guide arm 12.

The second portion 14*c* also has two specular toothed zones 14*d* and 14*d*' on either side of the flat tooth 14*a*, allowing reversible assembly on the window unit, as already indicated for the rack 13.

The rear surface of the second portion 14*c* does not have toothing and is shaped in such a way that it makes contact with the end of the movement arm 7 rigidly articulated to the first portion 14*b*.

In turn, the end of the movement arm 7 is shaped to match the rear surface of the second portion 14*c* so that it is always in contact with the latter, thus obtaining arm rotation, in both directions, even by means of thrust generated by the surface of the second portion 14*c*.

The first portion 14*b* of the pinion 14 comprises at least one stop tooth 14*e*, extending in a plane parallel with the remaining variable-pitch teeth 14*d* present on the second portion 14*c* and extending further than said teeth 14*d*.

Again in this case there are two teeth 14*e* and 14*e*' arranged specularly on the first portion 14*b* to allow pinion 14 reversible assembly on the window unit.

This stop tooth 14*e* can be housed in a respective hollow 20 in the rack 13 and both constitute mating surfaces. This hollow 20 is located next to the remaining toothing 13*b*, so that, when the sash 3 passes from a closed position to an open position, the connection of the tooth 14*e* in the hollow 20 gives the pinion 14—rack 13 movement regularity during this movement thanks to a stable tooth 14*e*—hollow 20 connection.

In other words, the tooth 14*e* helps in the transition step of the first pinion 14—rack 13 meshing, stabilising the connection with a regular sash 3 opening—closing movement and avoiding "jerking" when the handgrip 10*a* is turned.

Figure 4:
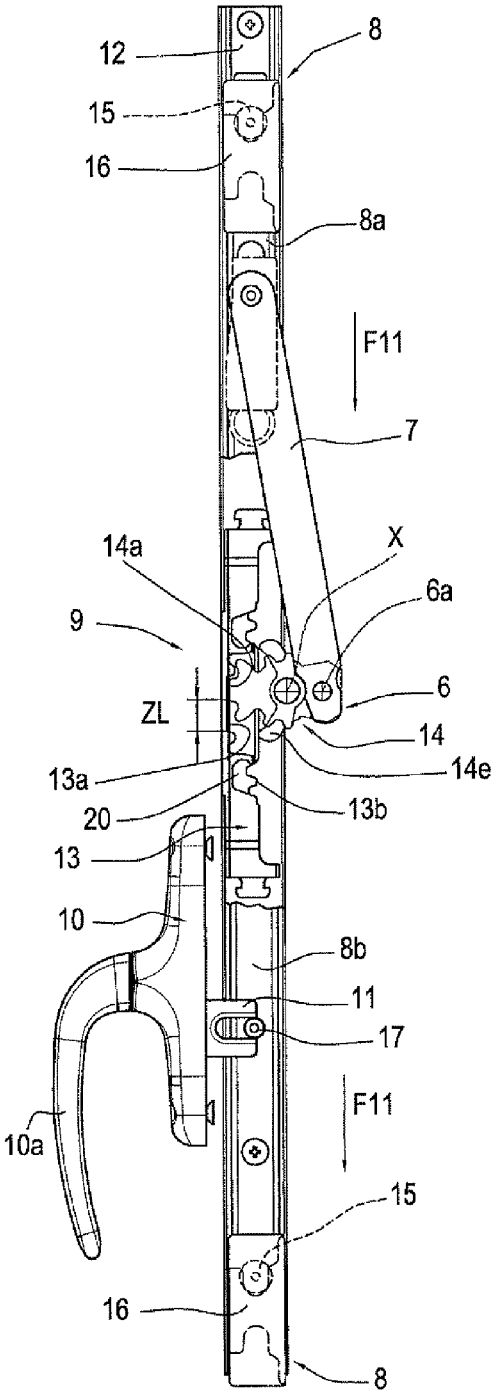
FIGS. 4, 5 and 6 show an operating and closing slide unit for the window sash as in the previous Figures, in three different configurations, that is, window closed and locked, released, and open configurations; wherein the FIGS. 4, 5 and 6 are in view V1 with respect to FIG. 3 (see arrow V1 in FIG. 3) and all the Figures have parts removed to better highlight other parts of greater interest.

In addition, the tooth 14*e* also has an anti-rotation function preventing the arm 7 from turning when the pins 15 are being released, since the teeth are in contact with one wall of the rack 13 (as shown in FIG. 4).

In this case, too, there is a specular hollow 20' on the rack 13 to allow reversible assembly on the window unit.

An alternative embodiment of the kinematic pair 13 and 14 described above is illustrated in FIGS. 16 to 18.

In this embodiment, the portion of the slide 9 forming the rack 13 is structured in such a way as to comprise a central toothed zone and a bilateral sliding zone on both sides only for moving the closing elements 8.

More specifically, the rack of this embodiment comprises (with the same reference numbers as those of the previous embodiment):

- a central, variable-pitch toothing zone 13*b* forming the surface which can mesh with a respective surface of the pinion 14, and
- two linear sections 13*a* and 13*a*' located on either side of the central toothing zone 13*b*.

One of the sections 13*a*, 13*a*' can be engaged by a flat operating portion 14*a* of the pinion 14 by operating the control handle 10 to obtain relative sliding without rotation of the pinion 14, where the movement arm 7 is stationary and positioned between the respective stiles 2*c*, 3*c* of the fixed frame 2 and sash 3: this allows the sash 3 to be released, or locked, by the closing elements 8.

The pinion 14, in this embodiment, has a simpler constructional architecture comprising, in addition to the linear sliding surface 14*a*, a single initial meshing tooth 14*e* and the meshing teeth 14*d*, 14*d*' for the toothing 13*b* of the rack 13.

The initial meshing tooth 14*e*, of which there is only one, is fan-shaped and engages a single central hollow 20 in the rack 13.

During the releasing stroke of the closing elements 8, the tooth 14*e* remains in contact with a linear wall of the rack 13 to avoid undesired swinging of the arm 7.

This structuring of the kinematic pair 13 and 14 makes it possible to move the arm 7 with the handle 10 extremely rapidly and with the minimum of effort by the user thanks to the centred position of the rack 13 toothing relative to the position of the handle 10.

Figure 18:
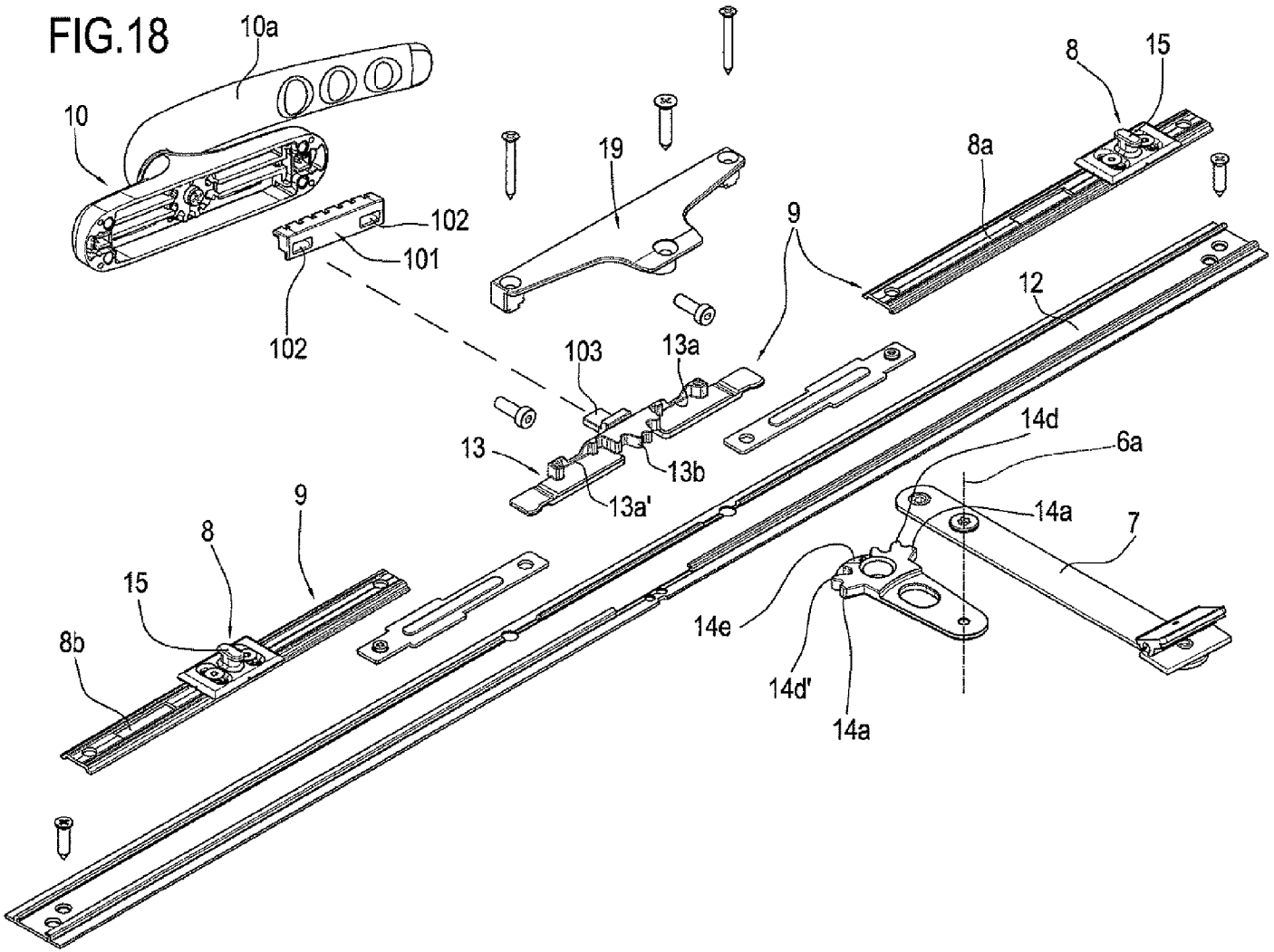
FIG. 18 is an exploded, perspective view of the slide unit of FIG. 16.

As confirmation of this, the handle 10, see FIG. 18, comprises a connecting element 101 (basically a carriage) featuring at least one coupling seat 102 for a drive 103 integral with the back of the rack 13 and protruding from the latter.

The carriage 101 is provided with two seats 102 allowing reversibility of the window unit 1 (right-hand or left-hand opening).

Figure 19:
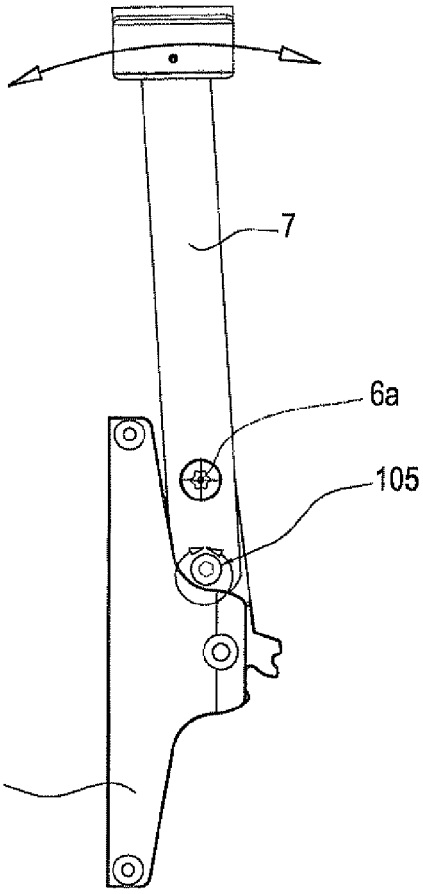
FIGS. 19 to 21 illustrate a cam element for angular adjustment of the arm relative to the pinion and to the slide respectively in a front view, a perspective view and a view from K with reference to FIG. 20.
Figure 20:
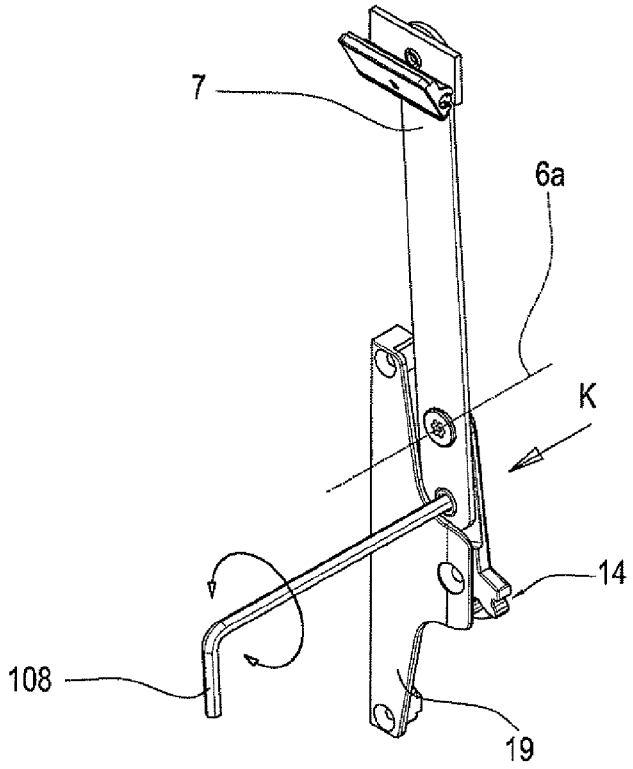
Figure 21:
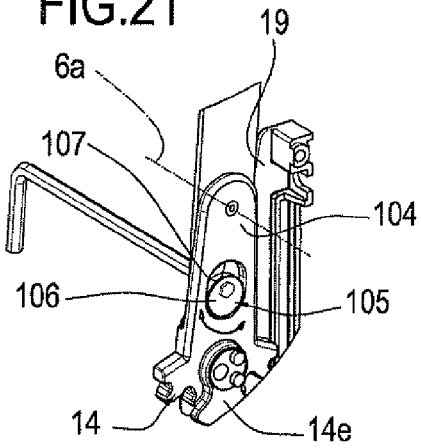

FIGS. 19 to 21 illustrate a further accessory used on the window unit of the invention, namely, a system for angular adjustment of the arm 7 relative to the kinematic pair 13 and 14, when the arm 7 has moved to the window closed position: this system makes it possible to precisely adjust the position of contact between the fixed frame 2 and the sash 3 according to the amount of play, if any, introduced during assembly or created after use for some time.

In this system, the pinion 14 is equipped with an extension 104 for connection to the end of the arm 7.

Between the arm 7 and the extension 104 there is an interposed adjustment cam element 105 for adjusting the angular position of the arm 7 relative to the extension 104 when the sash 3 is in the closed position.

More specifically, the cam element 105 comprises a washer 106 rotatably and eccentrically associated with the arm 7 and housed in a seat 107 having an ellipsoidal profile, made in the extension 104.

Adjustment is performed using a suitable key 108 to turn the washer 106 about the point of connection to the arm 7. Turning the washer 106 varies its contact with the profile of the seat 107 and imparts to the arm 7 an angular movement in one direction or the other relative to the extension 104.

Figure 16:
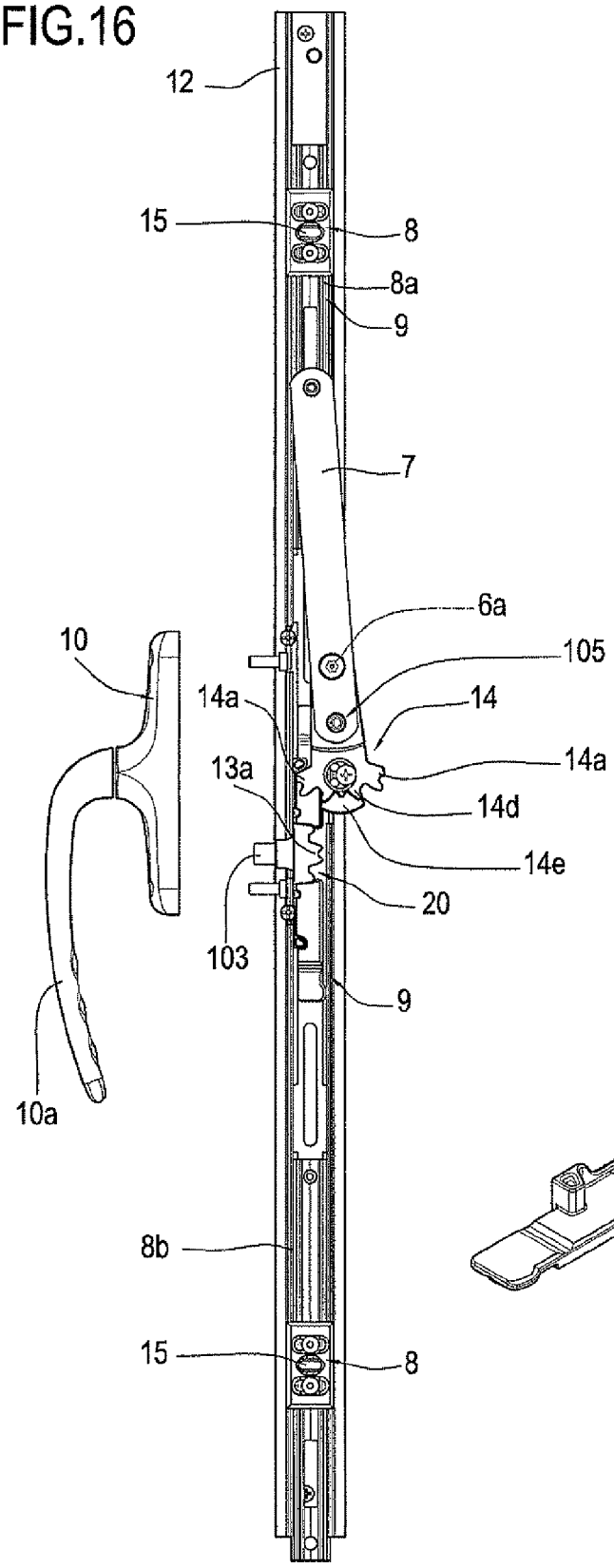
FIG. 16 is a front, partly exploded view of another embodiment of the operating and closing slide unit.
Figure 17:
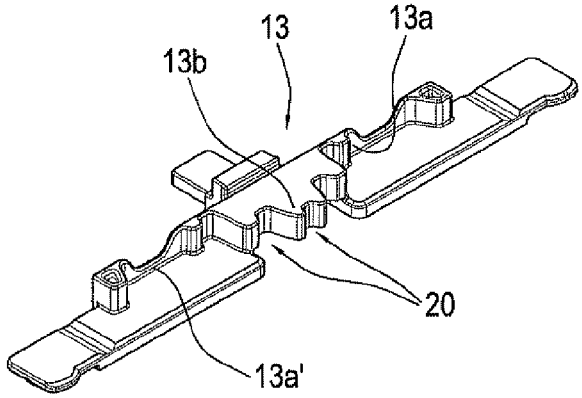
FIG. 17 is a perspective view of another embodiment of the rack forming part of the slide unit.

Therefore, a window unit 1 structured in this way operates as follows, starting from a closed configuration as shown in FIG. 2, 4 or 16.

The user finds the handle 10 with the handgrip 10*a* pointing, for example, downwards, whilst the bosses 15 are connected inside the strikers 16 on the sash 3, and the arm 7 is interposed between the respective stiles 2*c* and 3*c* (see FIG. 4).

Figure 5:
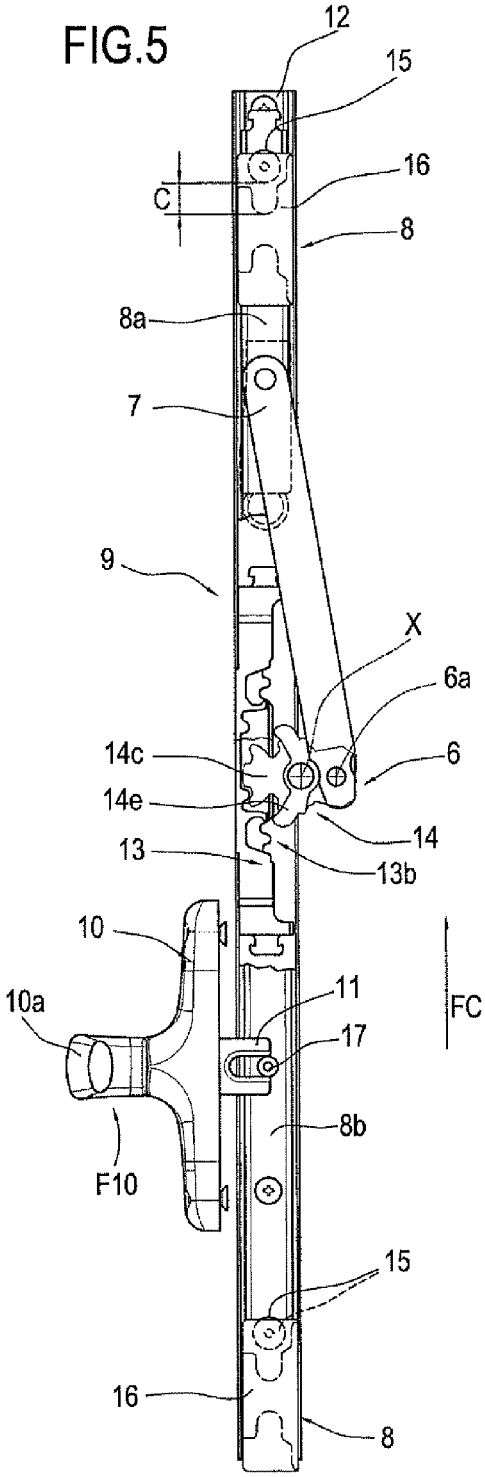

A first 90° turn of the handgrip 10*a* (arrow F10 in FIG. 5) causes, thanks to the drive element 11 acting on the pin 17, sliding of the rod portions 8*a*, 8*b* and of the rack 13 upwards for a stroke C (see respective arrows FC) designed to release the bosses 15 from the strikers 16, whilst the flat surfaces 13*a*, 14*a* of the rack 13 and the pinion 14 ensure that the arm 7 remains stationary in its position (see FIG. 5).

Figure 6:
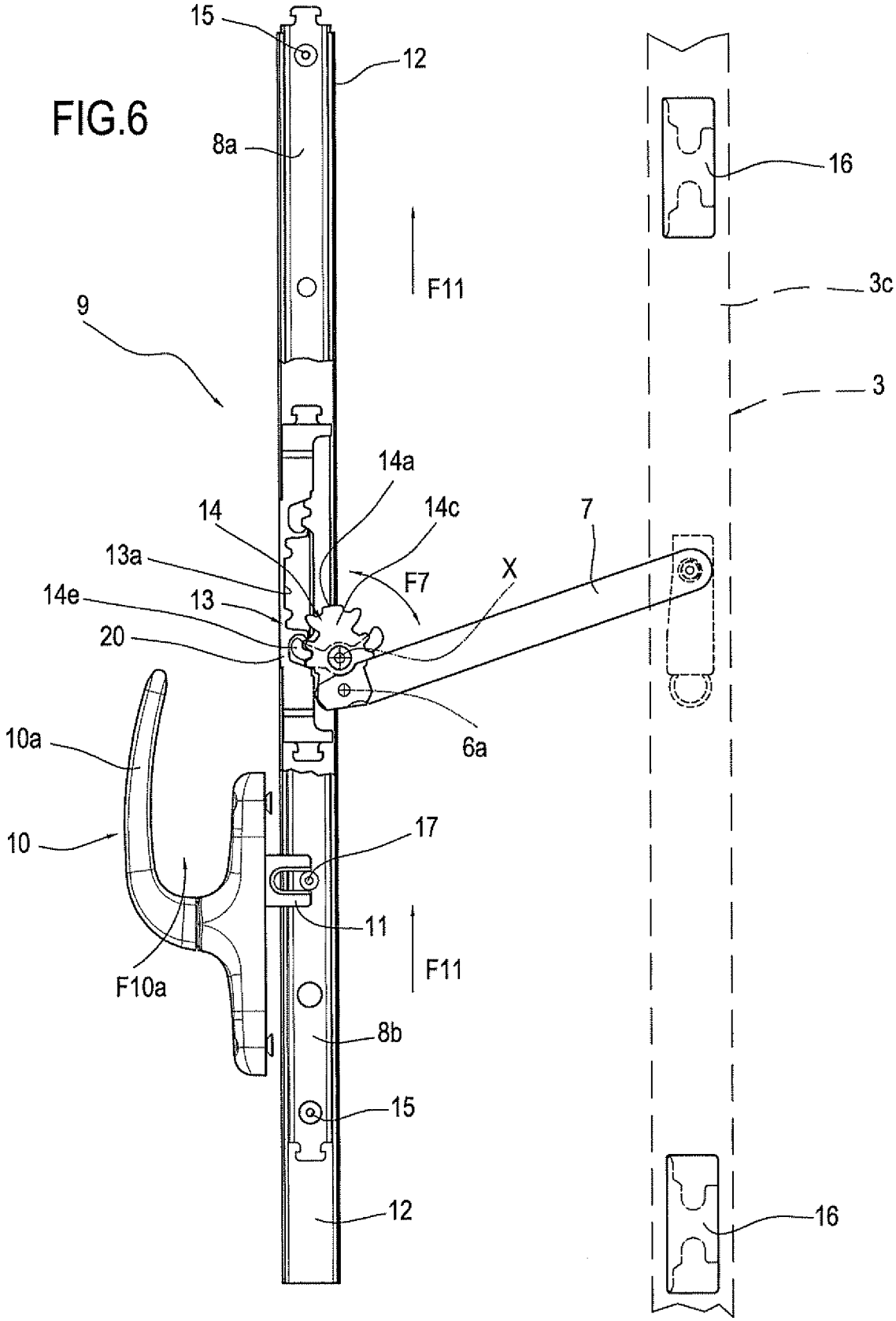
Figure 7:
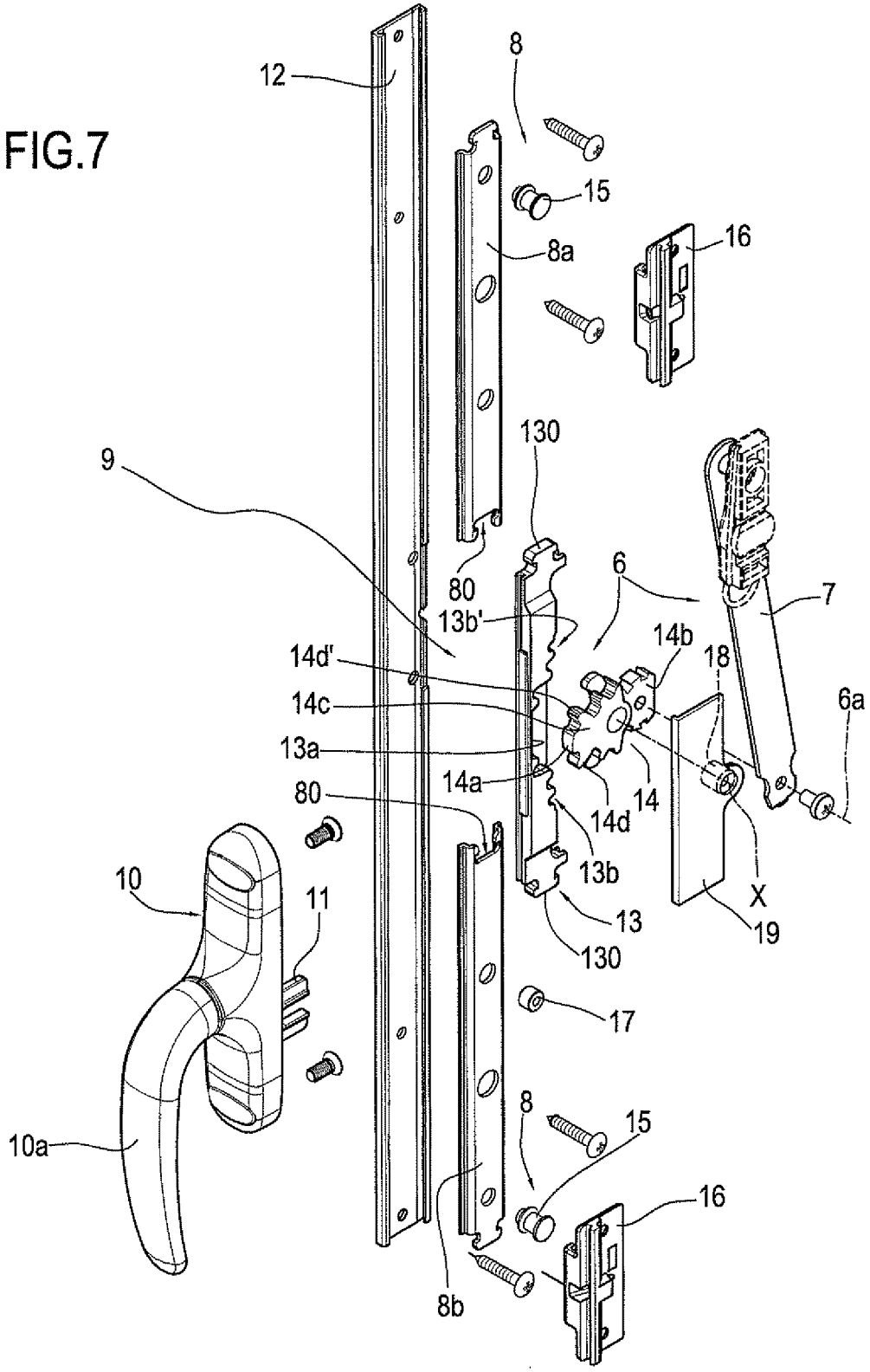
FIG. 7 is an exploded perspective view of the locking and operating slide unit of FIGS. 4 to 6.
Figure 8:
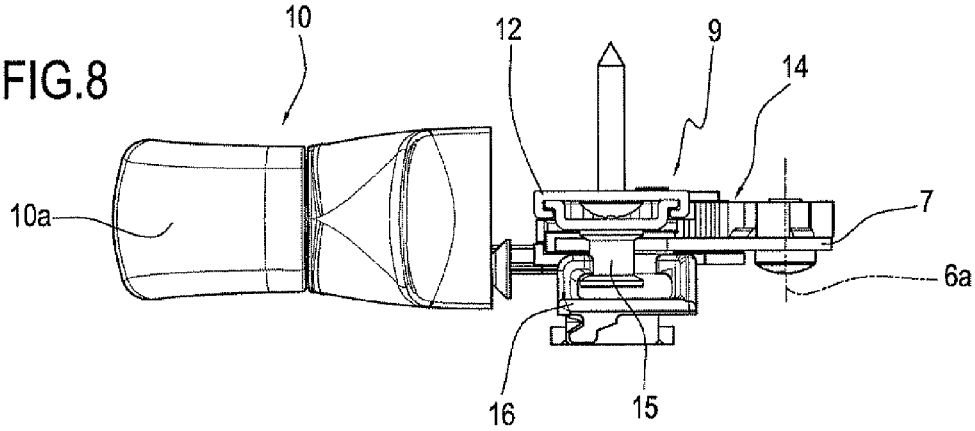
FIG. 8 is a top plan view of the locking and operating slide unit of FIGS. 4 to 7 in a sash closed and locked configuration.
Figure 9:
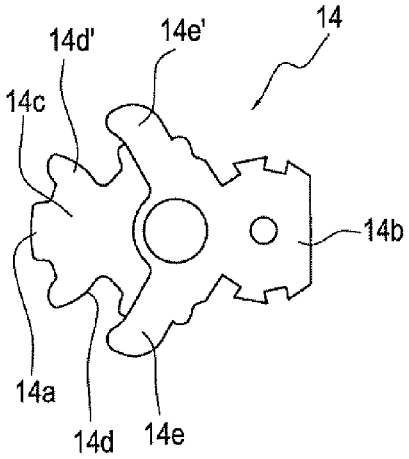
FIGS. 9 to 12 are respectively a rear side view, a front view, a front side view and a perspective view of a pinion forming part of a kinematic pair for connecting the locking and operating slide unit.
Figure 10:
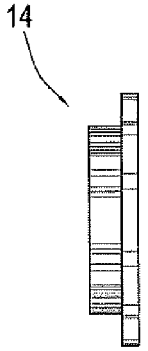
Figure 11:
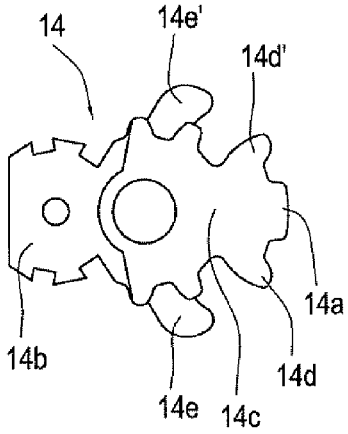
Figure 12:
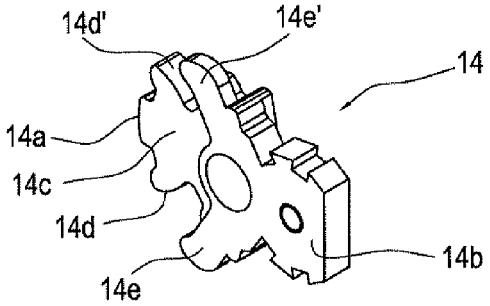
Figure 14:
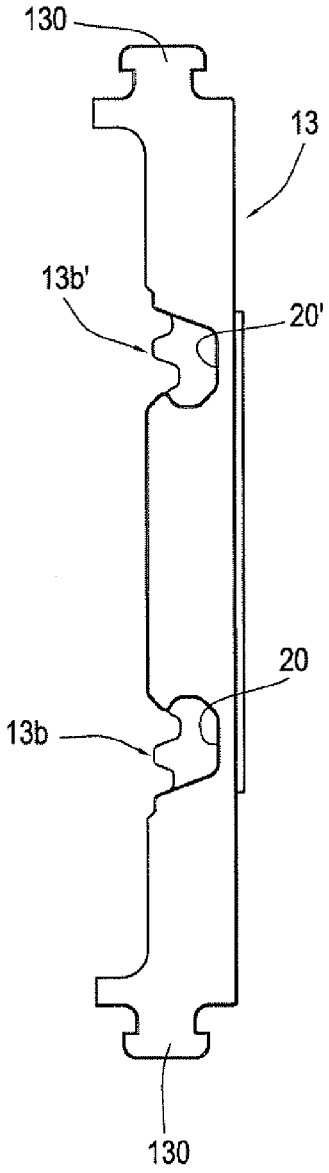
FIGS. 13 to 15 are respectively a front face view, a rear face view and a perspective view of a rack forming part of the locking and operating slide unit.

At this point, with the sash 3 released, the subsequent turn of the handgrip 10*a* upwards (see arrow F10*a* in FIG. 6) causes further upward sliding of the rod portions 8*a* and 8*b* and of the rack 13 with consequent meshing of the mating surfaces of the rack 13 and the pinion 14 (arrows F11 in FIG. 6).

This meshing causes the pinion 14 to rotate (arrow F7 in FIG. 6) and consequent rotation of the arm 7 which moves the sash 3 with sash rotation—translation towards the open position (see FIGS. 3 and 6).

To close and lock the sash 3 again, the sequence is inverted both as regards turning the handgrip 10*a* and the movements of the components belonging to the unit 9.

A window unit structured in this way therefore fulfils the preset aims thanks to the presence of a slide unit which forms both the operating unit and the support for the locking/releasing elements located on the fixed frame.

This structure allows just one machining operation to be performed on the window unit, making a slot in the fixed frame stile, and assembly of a compact, secure unit on the fixed frame stile.

The arm acting on the sash, moved on the sash stile, avoids the need for additional work on the inner profiles of the fixed frame, since it is far from the hinged arms which are positioned at the rails.

All of this results in the production of a window unit which is practical and easy to operate with extremely low final installation costs compared with conventional ones.

The invention described above is susceptible of industrial application and may be modified and adapted in several ways without thereby departing from the scope of the inventive concept. Moreover, all the details of the invention may be substituted by technically equivalent elements.

The invention claimed is:

1. A casement window unit, the window unit (1) comprising at least:

- a fixed frame (2) having a pair of vertical members or fixed stiles (2*c*), parallel with each other, and a pair of horizontal members or rails (2*a*, 2*b*) parallel with each other;
- a sash (3) having a pair of vertical members or stiles (3*c*), parallel with each other, and a pair of horizontal members or rails (3*a*, 3*b*), parallel with each other, and being connected to the fixed frame (2) by
- a pair of hinged members (4, 5) joined to respective members of the fixed frame (2) and of the sash (3) so as to allow the sash (3) to move between a closed position, where the fixed frame (2) and the sash (3) are in contact with each other, and an open position, where at least one stile (3*c*) of the sash (3) is at a certain distance from the fixed frame (2) towards an outside of a room where the window unit (1) is installed;

at least one movement arm (7) configured to move the sash (3) from the closed position to the open position, and vice versa;

elements (8) for stably closing or locking or releasing the sash (3) closed position on the fixed frame (2), located on, and acting between, the fixed frame (2) and the sash (3) at least at respective vertical stiles, the window unit being characterized in that the window unit comprises:

at least one operating slide (9) located and movable within a fixed stile (2*c*) of the fixed frame in order to slidably support the elements (8) located on the fixed frame (2);

an operating kinematic pair (13, 14) connecting the slide (9) to a first end of the movement arm (7), the arm (7) being articulated, at a second end, to a stile (3*c*) of the sash (3);

a control handle (10) associated with the outside of a fixed stile (2*c*) and connected to the slide (9) in order to move the slide, when actuated manually to predetermined positions, to allow, in sequence, first the sash (3) to be released from the fixed frame (2) and then the sash (3) to be moved towards the open position, and vice versa, and wherein the kinematic pair (13, 14) comprises a variable-pitch rack (13) which is formed on a portion of the slide (9); the rack (13) acting in conjunction with a variable pitch pinion (14) to which an end of the movement arm (7) of the sash (3) is articulated; the rack (13) and the pinion (14) having surfaces which can mesh to generate the sequential movements for sash (3) opening and closing by rotation of the movement arm (7).

2. The window unit according to claim 1, characterized in that the handle (10) is provided with a connecting element (11) for connection to the slide (9) in order to allow the sequential movements when a handgrip (10*a*) is turned.

3. The window unit according to claim 1, characterized in that the slide (9) is housed inside a supporting guide arm (12) associated with an inside of a fixed stile (2*c*) and in which the slide (9) itself is slidable.

4. The window unit according to claim 1, characterized in that the slide (9) comprises at least two separate portions that can be joined to each other inside a supporting guide arm (12);

a first portion mounting the elements (8) for closing the fixed frame (2) and the other portion constituting one of the members of the kinematic pair (13, 14).

5. The window unit according to claim 1, characterized in that the slide (9) is divided into at least three separate portions, of which two portions are rods (8*a*, 8*b*) located on opposite sides of a supporting guide arm (12) and able to be connected to a portion of the slide (9) on which the rack (13) is formed; each rod portion (8*a*, 8*b*), comprising at least one pin (15), or boss, for engaging a respective striker (16) positioned on a lateral surface of a stile (3*c*) of the sash (3) when the sash (3) is in the closed position.

6. The window unit according to claim 5, characterized in that one of the rod portions (8*b*) is equipped with a pin (17) or boss able to engage in a drive element (11) on the control handle (10) positioned on a fixed stile (2*c*), allowing simultaneous sliding of the rod portions (8*a*, 8*b*) and of the kinematic pair (13, 14) along the guide arm (12) in both directions, thus generating the sequential movement for opening and closing the sash (3).

7. The window unit according to claim 1, characterized in that the rack (13) and the pinion (14) comprise a flat operating portion (13*a*, 14*a*) designed to allow the rack (13) and the pinion (14) to slide relative to each other without rotation of the pinion (14), when the control handle (10) is operated, during which the movement arm (7) is stationary and positioned between the respective stiles (2*c*, 3*c*) of the fixed frame (2) and of the sash (3), and allowing the sash (3) to be released, or locked in place, by the closing elements (8).

8. The window unit according to claim 7, characterized in that the flat operating portion (13*a*) of the rack (13) constitutes a linear zone of the rack (13) which is connected to at least one section of a variable-pitch toothing (13*b*) forming a surface able to mesh with a respective surface of the pinion (14); the linear zone having a length which corresponds to at least a disengaging linear movement by a rod portion supporting pin (15) from a striker (16) on the sash (3).

9. The window unit according to claim 7, characterized in that the pinion (14) comprises:

a first, supporting portion (14*b*), to which the movement arm (7) is rigidly articulated, and a second, operating control portion (14*c*), which is thicker than the first portion (14*b*), the second portion (14*c*) comprising a flat-profile front zone (14*a*) and at least one zone, adjacent to the flat-profile front zone (14*a*), having toothing (14*d*) which can mate or mesh with the respective toothing (13*b*) of the rack (13); the second portion (14*c*) being rotatably connected to a pin (18) which is part of a rack (13) covering element (19) and integral with a guide arm (12).

10. The window unit according to claim 9, characterized in that the second portion (14*c*) of the pinion (14) comprises a rear surface which does not have toothing and makes contact with the first end of the movement arm (7) articulated to the first portion (14*b*); the first end of the movement arm (7) being shaped to match the rear surface of the second portion so that the first end of the movement arm (7) is always in contact with the surface of the second portion (14*c*), thus obtaining arm rotation, in both directions, even by means of thrust generated on the surface of the second portion (14*c*).

11. The window unit according to claim 9, characterized in that the first portion (14*b*) of the pinion (14) comprises at least one stop tooth (14*e*), extending in a plane parallel with the toothing (14*d*) present on the second portion (14*c*) and extending further than said toothing (14*d*); the stop tooth (14*e*) being designed to be housed in a respective hollow (20) in the rack (13), constituting a mating surface, the hollow (20) being located next to the remaining toothing (13*b*) when a sash (3) passes from a closed position to an open position, and the stop tooth (14*e*) being designed to allow regular pinion (14) and rack (13) movement during said sash movement.

12. The window unit according to claim 1, characterized in that the rack (13) comprises:

a central, variable-pitch toothing zone (13*b*) forming a surface which can mesh with a respective surface of the pinion (14), and two linear sections (13*a*, 13*a*') located on either side of the central toothing zone (13*b*); one of the sections (13*a*, 13*a*') being engageable by a flat operating portion (14*a*) of the pinion (14) by operating the control handle (10) to obtain relative sliding without rotation of the pinion (14), where the movement arm (7) is stationary and positioned between the respective stiles (2*c*, 3*c*) of the fixed frame (2) and of the sash (3) to allow the sash (3) to be released, or locked in place, by the elements (8).

13. The window unit according to claim 1, characterized in that the handle (10) comprises a connecting element (101) featuring at least one coupling seat (102) for a drive (103) integral with a back of a rack (13) and protruding from the latter.

14. The window unit according to claim 1, characterized in that the pinion (14) is equipped with an extension (104) for connection to the first end of the arm (7); there being, between the arm (7) and the extension (104), an interposed adjustment cam element (105) for adjusting the angular position of the arm (7) relative to the extension (104) when the sash (3) is in the closed position.

* * * * *

UNITED STATES PATENT AND TRADEMARK OFFICE

CERTIFICATE OF CORRECTION

PATENT NO. : 8,733,021 B2
APPLICATION NO. : 13/497014
DATED : May 27, 2014
INVENTOR(S) : Marco Lambertini It is certified that error appears in the above-identified patent and that said Letters Patent is hereby corrected as shown below:

In the Claims:

In column 9, line 46, being line 5 of claim 4, please delete “the other” and insert therefor --another--.

Signed and Sealed this
Second Day of September, 2014

Michelle K. Lee

Michelle K. Lee
*Deputy Director of the United States Patent and Trademark Office*